US006955154B1

(12) United States Patent
Douglas

(10) Patent No.: US 6,955,154 B1
(45) Date of Patent: Oct. 18, 2005

(54) FUEL INJECTOR SPARK PLUG

(76) Inventor: Denis Douglas, P.O. Box 344, Soldotna, AK (US) 99669

( * ) Notice: Subject to any disclaimer, the term of this patent is extended or adjusted under 35 U.S.C. 154(b) by 0 days.

(21) Appl. No.: 10/926,927

(22) Filed: Aug. 26, 2004

(51) Int. Cl.[7] ..... F02M 57/06
(52) U.S. Cl. ..... 123/297; 313/120; 313/139
(58) Field of Search ..... 123/151, 152, 123/297; 239/585.1, 585.5; 313/120, 139

(56) References Cited

U.S. PATENT DOCUMENTS 1,333,897 A * 3/1920 Bringman ..... 313/120
3,665,902 A * 5/1972 Bloomfield ..... 123/297
RE29,978 E * 5/1979 Leshner et al. ..... 123/297
5,497,744 A * 3/1996 Nagaosa et al. ..... 123/297
5,531,199 A * 7/1996 Bryant et al. ..... 123/297
6,536,405 B1 * 3/2003 Rieger et al. ..... 313/120
2003/0111042 A1 * 6/2003 Rieger et al. ..... 123/297

* cited by examiner

*Primary Examiner*—Erick Solis
(74) *Attorney, Agent, or Firm*—Michael J. Tavella

(57) ABSTRACT

A spark plug and fuel injector combination. The spark plug has a central channel that funnels fuel into the lower portion of the spark plug, where it is superheated. A solenoid system causes a needle valve to rise up to allow a measured quantity of fuel to be injected into a cylinder through a nozzle, where it vaporizes upon exiting the spark plug. A spring releases the needle valve to close the nozzle. The spark plug also has an ignition ring on the base. The ignition ring produces an encompassing spark, which produces complete combustion of the vaporized fuel. This produces more power and better fuel economy.

12 Claims, 6 Drawing Sheets

FUEL INJECTOR SPARK PLUG

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to fuel injector spark plugs and particularly to fuel injector spark plugs that vaporize fuel prior to injection.

2. Description of the Prior Art

Spark plugs and fuel injectors have been used in internal combustion engines since the inception of such engines. In recent years, almost all engines use fuel injection in combination with traditional spark plugs in gasoline engines. Although this is a good combination, there are some inefficiencies in delivering the fuel to the cylinder separately from the spark plug. By injecting the fuel right at the source of the spark, it is possible to enhance the power generated and to burn the fuel more completely. To that end, several spark plug-injector patents have been issued. Examples of these are found in U.S. Pat. Nos. 1,310,970, 2,795,214, 3,173,409, 4,095,580, 5,497,744, 4,736,718, and 6,536,405.

In the past, it appears that engine damage was encountered because fuel was inadvertently vaporizing in the cylinder (manifold), ?? thereby causing too much pressure (power). As a result, additives were used to counter the problem.

BRIEF DESCRIPTION OF THE INVENTION

The instant invention is designed to overcome the problem of inadvertent or premature vaporization of fuel. Thus, the intent of the invention is to utilize vaporized fuels in engines currently being used because vaporized fuels produce a superior energy release.

The invention consists of a spark plug and fuel injector combination. The spark plug has a central channel that funnels fuel into the lower portion of the spark plug, where it is vaporized. A solenoid system causes a needle valve to rise up to allow a measured quantity of fuel to be injected into a cylinder through a nozzle. A spring releases the needle valve to close the nozzle. The spark plug also has an ignition ring on the base. The ignition ring produces an encompassing spark, which produces complete combustion of the vaporized fuel. This produces more power and better fuel economy.

It is an object of this invention to produce a fuel injector spark plug that creates and maintains an environment hospitable for vaporized fuels in a compression chamber.

It is another object of this invention to produce a fuel injector spark plug that delivers fuel vapor to cylinder directly to maintain the fuel in vapor form.

It is yet another object of this invention to produce a fuel injector spark plug that eliminates excess fuel use thereby eliminating excess heat.

It is a further object of this invention to produce a fuel injector spark plug that increases mileage and power.

It is a further object of this invention to produce a fuel injector spark plug that saves energy.

It is a further object of this invention to produce a fuel injector spark plug that allows all additives that restrict vaporization to be removed from fuel.

It is a further object of this invention to produce a fuel injector spark plug that allows all additives that are harmful to the environment to be removed from fuel.

It is a further object of this invention to produce a fuel injector spark plug that greatly simplifies engine components accessories, and operation.

DETAILED DESCRIPTION OF THE INVENTION

The instant invention is a spark plug-fuel injector that is designed to vaporize fuel and deliver it into a cylinder and ten ignite it to produce a highly efficient burn. As a result, some changes on engine operation are required. For example, due to the increased speed and efficiency of the fuel burn, the engine timing must change. In most gasoline engines, ignition occurs while the piston is still traveling upward. That means counter opposing force is being applied. The reason for this is that atomized fuel requires a certain amount of time to burn. If the engine timing is advanced, combustion occurs outside the combustion chamber and manifests itself as a backfire through the intake manifold. Moreover, if the timing is retarded, combustion is noted outside the combustion chamber in the form of a backfire into the exhaust manifold.

Using the instant invention, however, vaporized gasoline has far better burn characteristics. It allows timing changes that eliminate the counter opposing forces in the engine, which cause it to take on some of the advantageous features of a rotary engine.

Vaporized gasoline condenses when exposed to ambient air. Thus, it must remain vaporized throughout the combustion process to maintain its highly flammable state. That means it must be introduced to an environment with a high enough temperature to keep the fuel from condensing. The instant invention accomplishes this by injecting super heated fuel, under high pressure, into the compression chamber just as the piston starts its downward motion, and then immediately igniting it.

Figure 1:
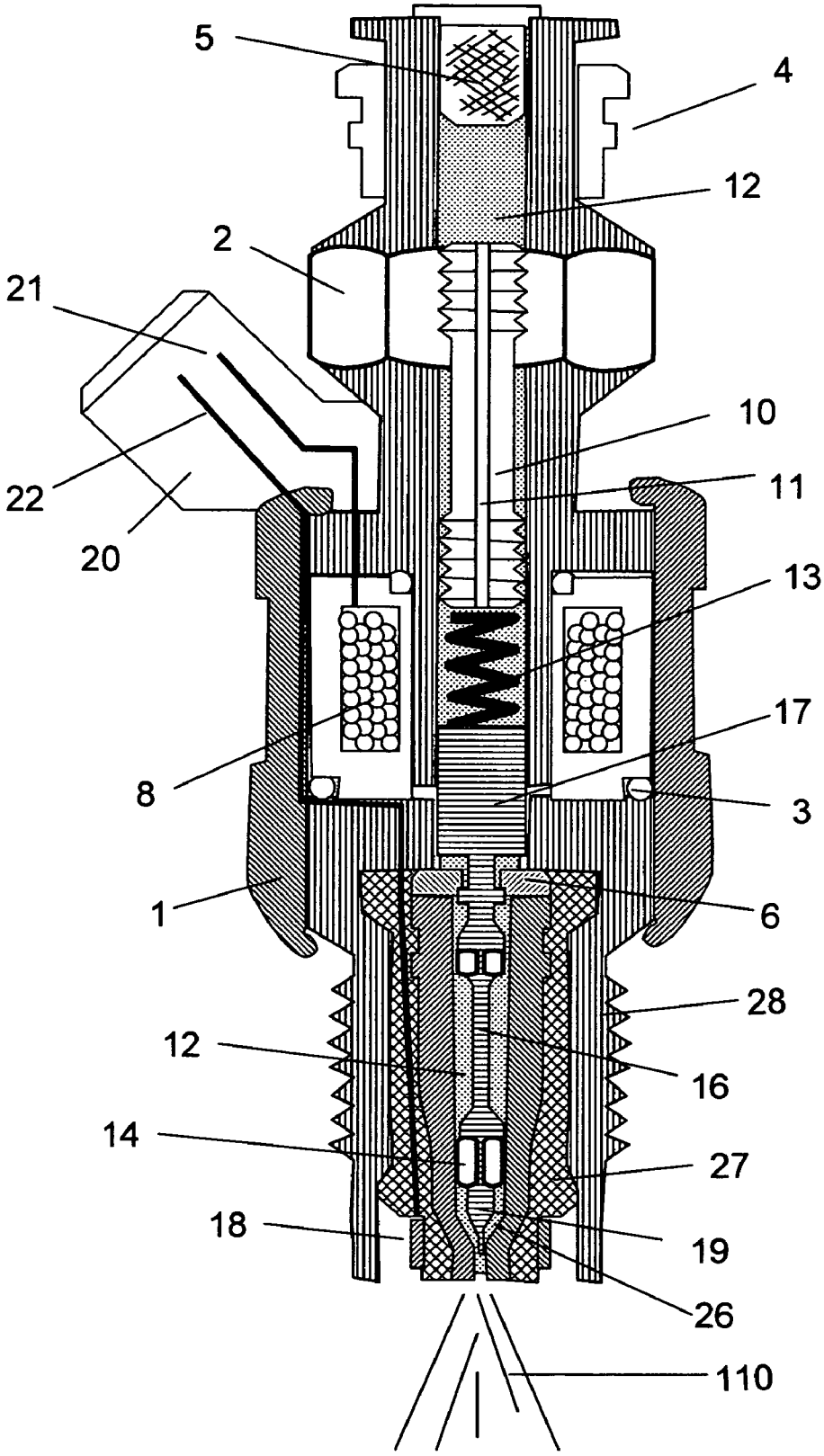
FIG. 1 is a cross-sectional view of the invention.

Referring now to FIG. 1, a cross-section of the injector spark plug 100 is shown. The plug has an outer shell 1. At the top of the plug is a formed portion that includes a hex nut portion 2. The center of the plug is hollow to accommodate a quantity of fuel. At the top of the hex nut portion 2 is an inlet port 4 for a fuel line, which has a screen 5 to filter the fuel. The hex nut portion 2 extends down to a middle portion 6 as shown. An outer shell 1 is used to join the hex nut portion 2 with a threaded lower portion 28, discussed below.

An O-ring 3 is used to make a seal. A solenoid coil 8 is placed about the center of the spark plug as shown. Below the solenoid coil 8, is a lower portion 28, which contains the fuel needle 16, ignition ring 18 and a porcelain insulator 27 (see FIGS. 2 and 3).

The hollow center portion acts as a fuel conduit. A flow restrictor 10 is placed in the hollow center as shown. A fuel passage 11 is formed in the center of the flow restrictor 10 as shown. This passage allows fuel 12 to run down the center of the spark plug to the lower portion of the plug. A needle 16 is used as a valve to hold the fuel in the plug until is it ready for use. A spring 13 is positioned below the flow restrictor as shown. The fuel needle 16 is positioned below the spring as shown. To top 17 of the needle 16 acts as a plunger that contacts the spring 13.

In operation, the lower portion, as discussed below, is designed to hold the needle in position to allow it to move up and down within the spark plug. The top of the needle 17 is made of a ferric metal that is controlled by the solenoid, as discussed below.

On one side of the spark plug is an electrical connector plug 20. This plug is designed to bring electric power into the spark plug. One conductor 21 brings positive power to the solenoid (the solenoid impulse conductor). Another conductor 22 brings power to the ignition ring 18. The solenoid impulse conductor sends power to the solenoid, which, when energized, pulls the plunger 17 upwards (as shown in FIG. 1). This action lifts the needle upward, which open the tip 15 of the plug, which in turn, allows a measured quantity of fuel 110 to exit the tip 15. Note that in the preferred embodiment, the needle 16 has flattened surfaces 14 that permit the fuel to flow down past the needle. The operation of the solenoid (which generates heat) and the pressure in the plug creates a situation where the fuel exiting the spark plug is a super heated liquid. This superheated fuel immediately vaporizes upon leaving the tip of the plug. This is discussed further below.

Figure 3:
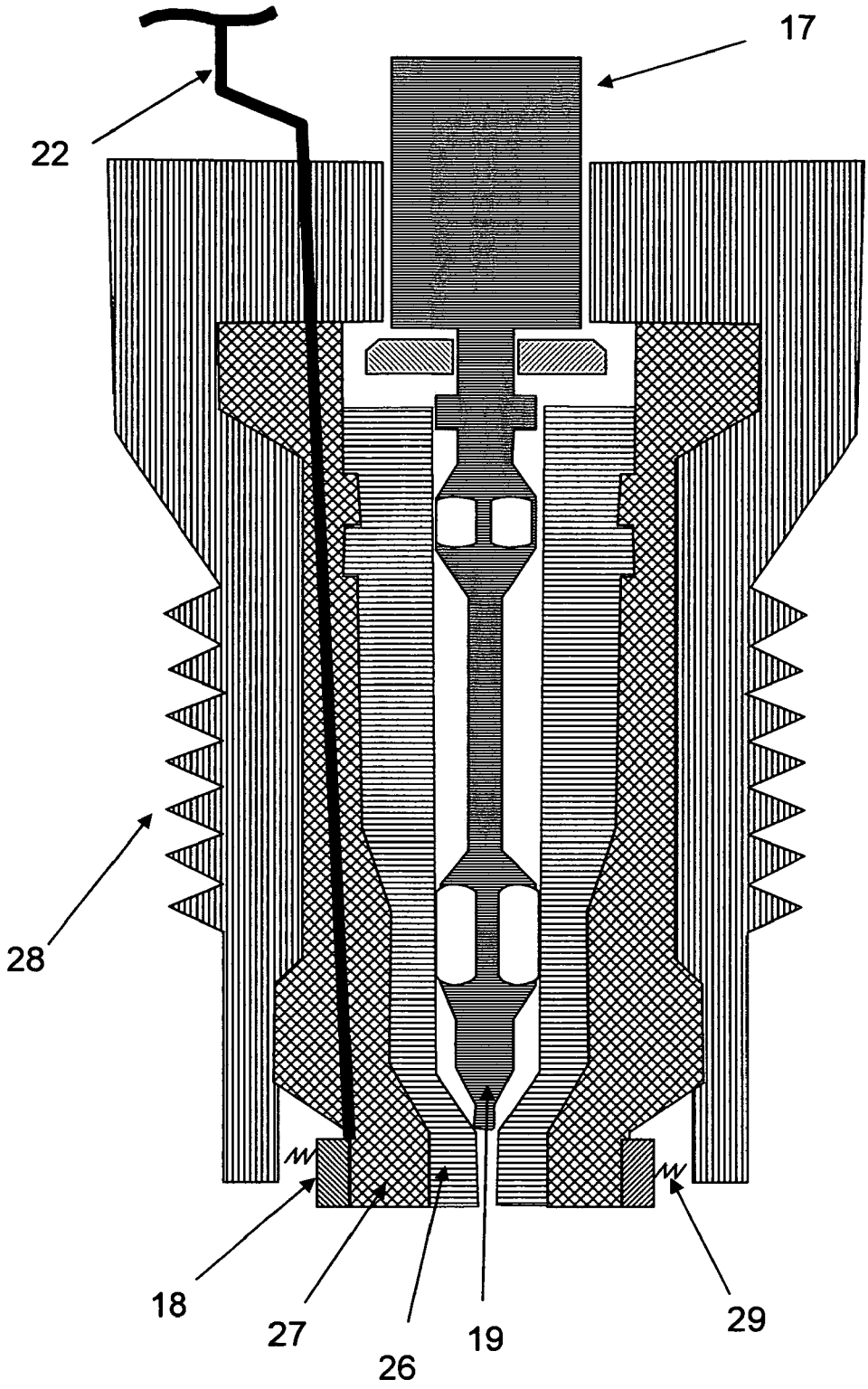
FIG. 3 is a cross-sectional view of the lower portion of the invention showing the fuel needle and ignition ring.

The travel of the needle (and plunger) is controlled by the spring 13*m* which causes to needle to be pushed down when the solenoid is de-energized and by a needle valve controller ring 6, which limits the upward travel of the needle 16 as well as the downward travel of the plunger 17 see FIG. 3.

Figure 2:
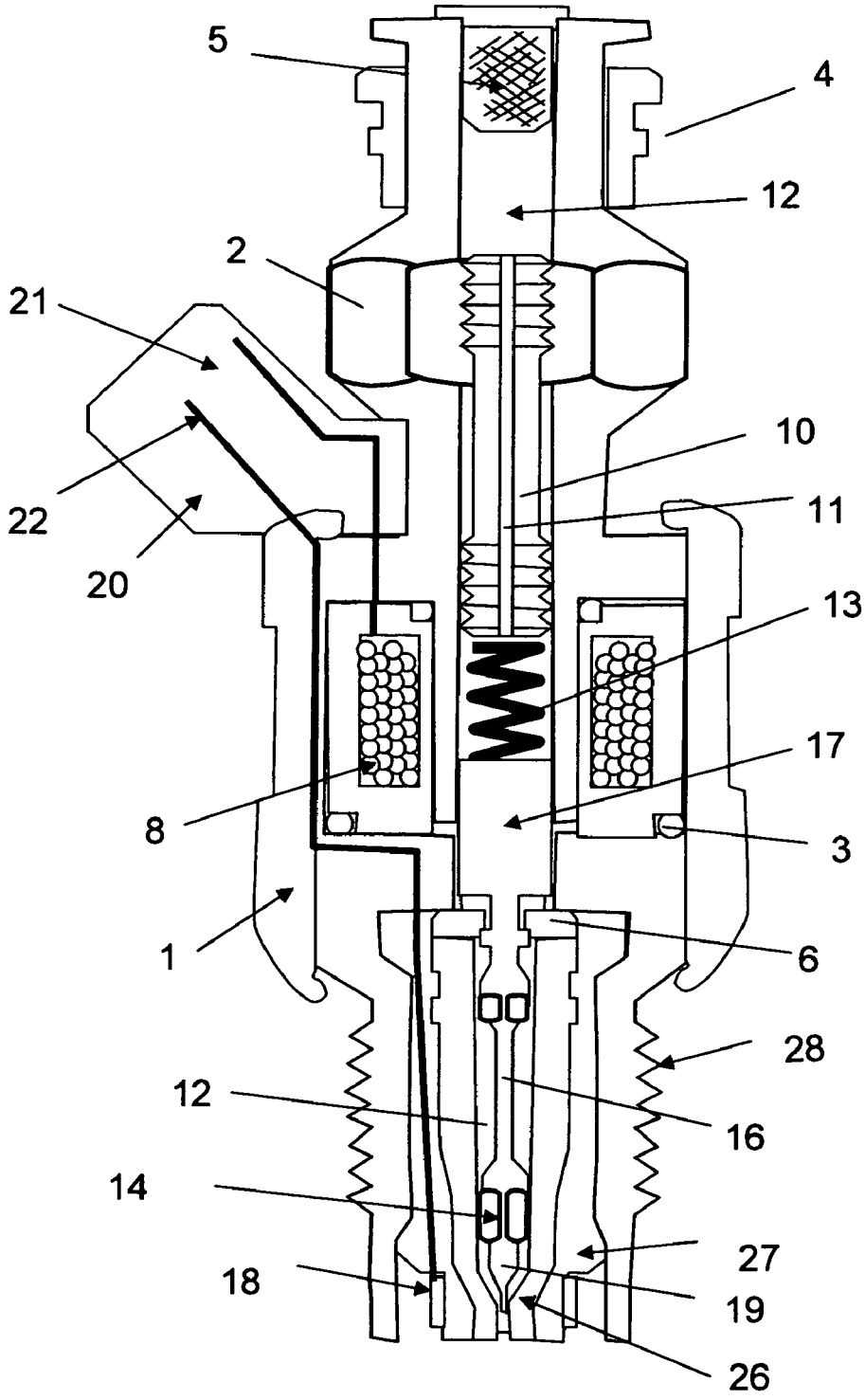
FIG. 2 is a cross sectional view of the invention showing the placement of the electrical leads.

FIG. 2 is a cross-section of the device 1 that more clearly shows the routing of the conductors 21 and 22.

FIG. 3 shows details of the lower portion. Here, the fuel needle 16 is in the "closed" positioned. This figure shows the collar 6 that is designed to hold the needle in position to allow it to move up and down within the spark plug. As mentioned above, the top of the needle 17 is a Ferris metal plug is shown. The lower portion of the needle 16 has a tip 19 that seats in a tapered nozzle 26. The ignition ring 18 is also shown in this figure. The action of the ignition ring is discussed below. Note that an insulator 27 is positioned between the ignition ring 18 and the nozzle 26. This insulation prevents flashover inward toward the nozzle. The threaded outer portion 28 of the lower portion of the spark plug is connected to ground to receive the spark 29 when power is sent to the ignition ring. Here, conductor 22 is shown extending down through the body of the plug.

Figure 4:
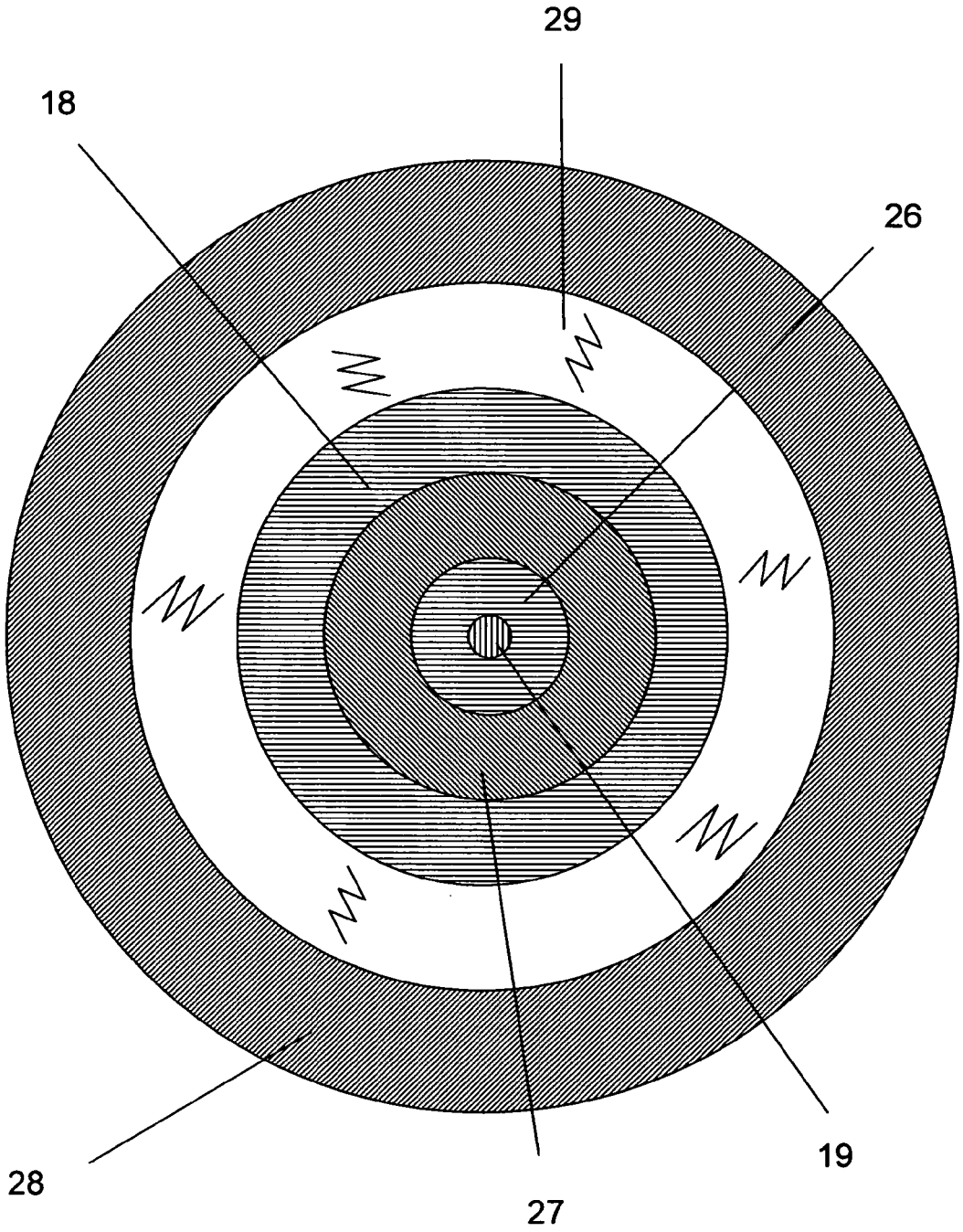
FIG. 4 is a detail of the ignition ring.

FIG. 4 shows the ring 18, the insulator 27, the outer portion 28 and the spark 29 from the bottom of the plug. As is clear in this figure, the ring 18 completely surrounds the center of the plug. Moreover, the outer portion 28 also is a continuous ring. This allows the spark 29 to provide complete ignition of the fuel in as efficient a manner as possible.

Figure 5:
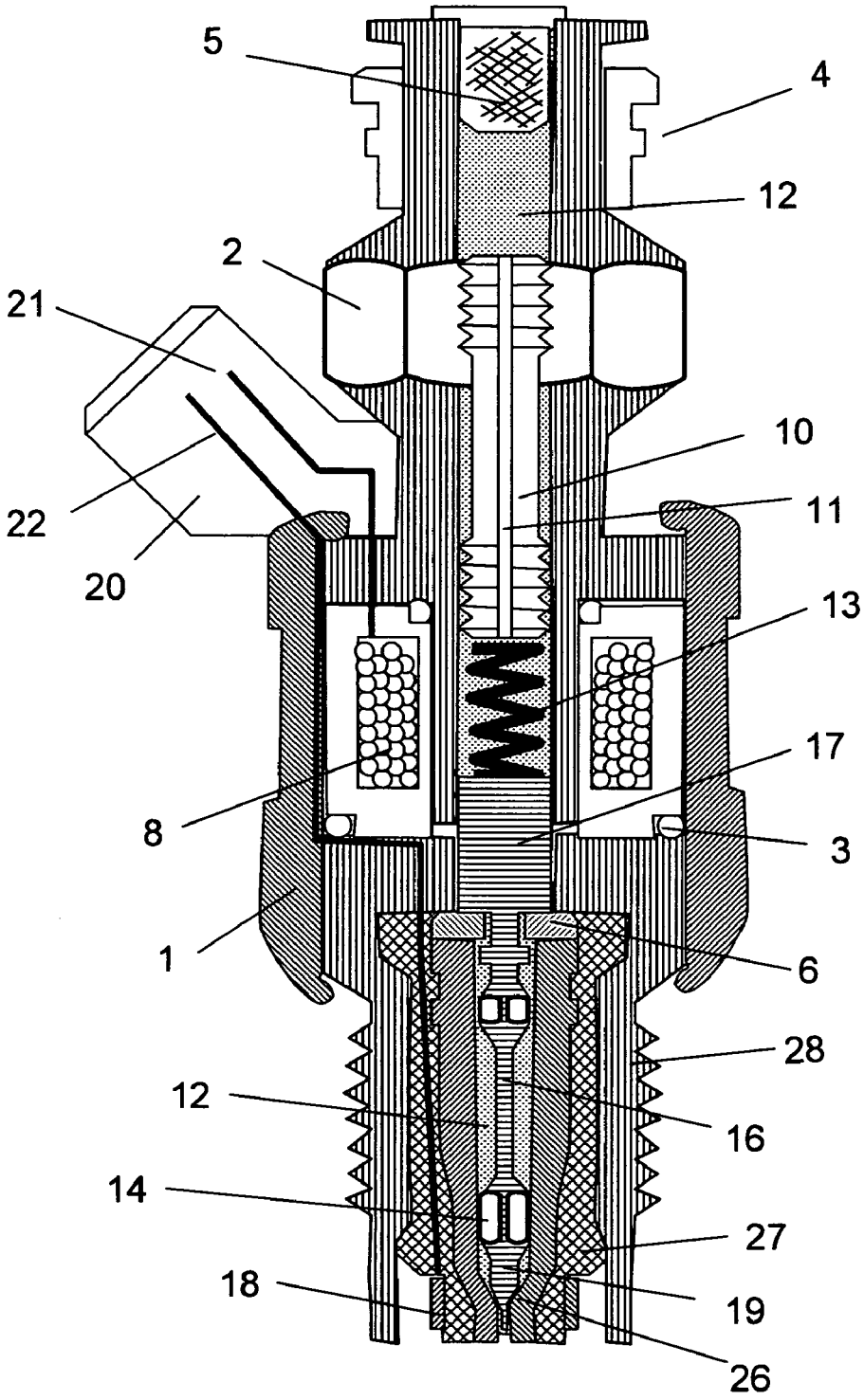
FIG. 5 is a bottom view of the invention showing the ignition ring.

FIG. 5 shows a cross-section of the device similar to that of FIG. 1, except that here, fuel 12 is shown in the lower portion and the needle valve is in the closed position.

Figure 6:
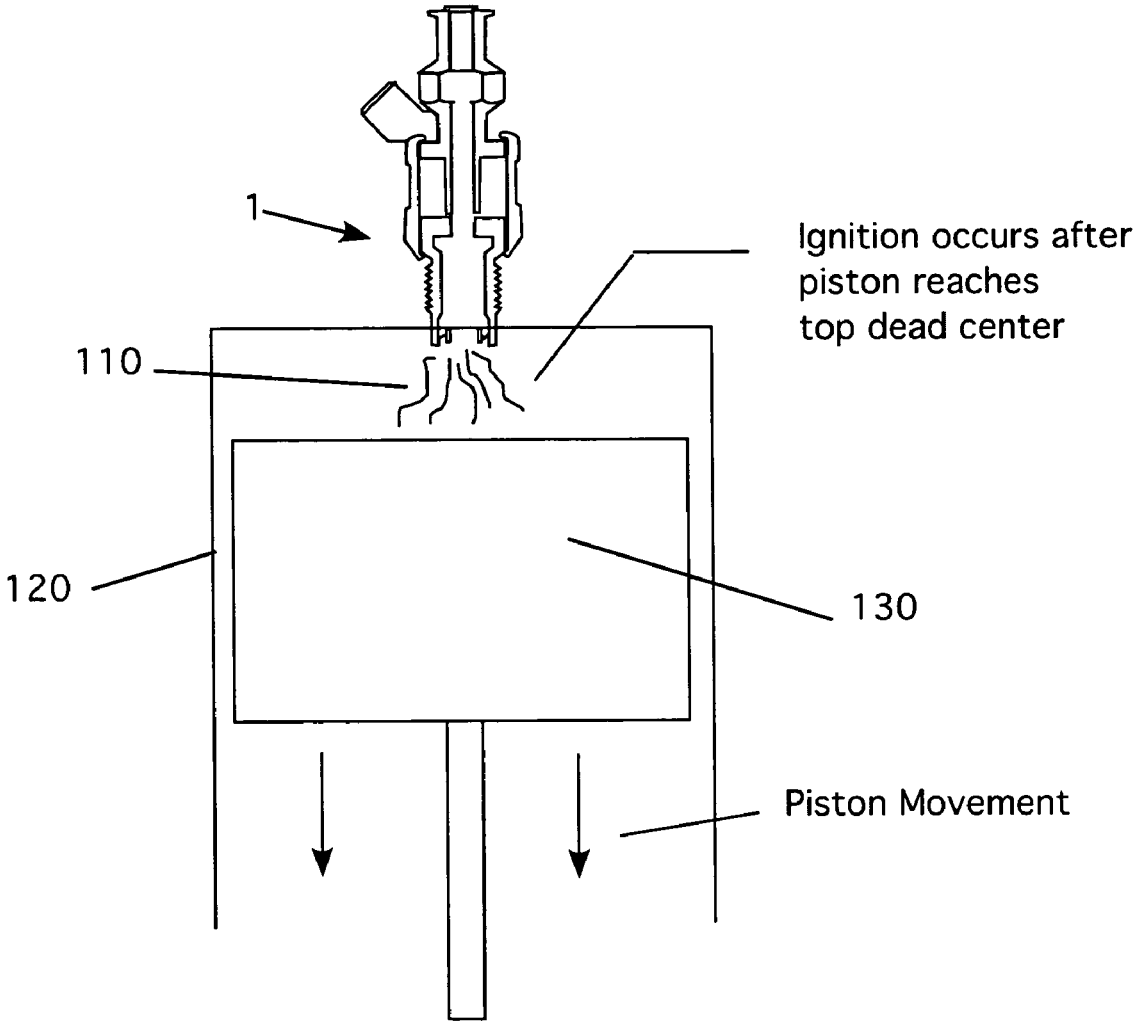
FIG. 6 is a detail view of an internal combustion cylinder showing the invention igniting after the piston reaches top dead center.

FIG. 6 is a detail view of an internal combustion cylinder 120 showing the invention 100 igniting after the piston 130 reaches top dead center. In operation, plug is full of superheated fuel as the piston 130 is rising in the cylinder 120. Just past top dead center, as the piston 130 begins its downward motion, the solenoid 8 caused the needle 16 to lift, which causes a quantity of fuel 110 to squirt into the cylinder 120, where it vaporizes immediately. Immediately after, a charge is sent to the ignition ring 18, which produces a spark 29 that ignites the fuel 110. Because the piston 130 is already in a downward motion, the firing of the fuel produces a power boost that provides more power to the stroke.

In a conventional engine, sufficient time is needed to allow the fuel to fully burn and produce energy. To accomplish this, the fuel is ignited while the piston is still rising in the cylinder. This procedure is not as efficient as it could be. Ideally, the piston should be moving down upon ignition, as in the case of the instant invention.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An integrated fuel injector-spark plug for injecting fuel directly into a combustion chamber of an internal combustion engine and for igniting the fuel that is injected into the combustion chamber, comprising:

a) a housing, having a bottom and a hollow core, and an outlet nozzle;

b) a needle valve, operably installed in said hollow core, such that when said needle valve is in a closed position, said needle valve seals said outlet nozzle;

c) a means for operating said needle valve;

d) an ignition ring, installed on the bottom of said housing, surrounding said outlet nozzle;

e) an insulating medium, positioned between said ignition ring and said outlet nozzle; and f) a grounding means, attached to said housing to attract an electrical charge from said ignition ring, thereby causing a spark ring about said bottom of said housing.

2. The integrated fuel injector-spark plug of claim 1 wherein the means for operating said needle valve comprises a solenoid.

3. The integrated fuel injector-spark plug of claim 1 wherein the spark is created on a timed control basis.

4. The integrated fuel injector-spark plug of claim 3 wherein the timed control basis is in coordination with the movement of a piston in a cylinder having a top dead center.

5. The integrated fuel injector-spark plug of claim 4 wherein the spark occurs after the piston has moved past top dead center.

6. An integrated fuel injector-spark plug for injecting fuel directly into a combustion chamber of an internal combustion engine and for igniting the fuel that is injected into the combustion chamber, comprising:

a) a housing, having a bottom and a hollow core, and an outlet nozzle;

b) a needle valve, operably installed in said hollow core, such that when said needle valve is in a closed position, said needle valve seals said outlet nozzle;

c) a means for operating said needle valve;

d) an ignition ring, installed on the bottom of said housing, surrounding said outlet nozzle;

e) an insulating medium, positioned between said ignition ring and said outlet nozzle; and f) a grounding means, attached to said housing to attract an electrical charge from said ignition ring, thereby causing a spark ring about said bottom of said housing;

g) wherein, a quantity of fuel being held in said hollow core is superheated within said housing before being dispensed.

7. The integrated fuel injector-spark plug of claim 6 wherein the means for operating said needle valve comprises a solenoid.

8. The integrated fuel injector-spark plug of claim 6 wherein the spark is created on a timed control basis.

9. The integrated fuel injector-spark plug of claim 8 wherein the timed control basis is in coordination with the movement of a piston in a cylinder having a top dead center.

10. The integrated fuel injector-spark plug of claim 9 wherein the spark occurs after the piston has moved past top dead center.

11. The integrated fuel injector-spark plug of claim 8 wherein a quantity of fuel being held in said housing is dispensed on a timed control basis.

12. The integrated fuel injector-spark plug of claim 8, wherein the quantity of fuel being is vaporized upon being dispensed from said housing.

* * * * *